US006710529B2

(12) United States Patent
Lee

(10) Patent No.: US 6,710,529 B2
(45) Date of Patent: Mar. 23, 2004

(54) COLOR CATHODE RAY TUBE

(75) Inventor: Jae Wook Lee, Taejonkwangyok-shi (KR)

(73) Assignee: LG.Philips Displays Korea Co., Ltd., Kyongsangbuk-Do (KR)

( * ) Notice: Subject to any disclaimer, the term of this patent is extended or adjusted under 35 U.S.C. 154(b) by 76 days.

(21) Appl. No.: 10/136,291

(22) Filed: May 2, 2002

(65) Prior Publication Data

US 2003/0122470 A1 Jul. 3, 2003

(30) Foreign Application Priority Data

Jan. 3, 2002 (KR) ..... P2002-286

(51) Int. Cl.[7] ..... H01J 29/80
(52) U.S. Cl. ..... 313/402; 313/407
(58) Field of Search ..... 313/402, 404, 313/405, 407, 408

(56) References Cited

U.S. PATENT DOCUMENTS

| | | | |
|---|---|---|---|
| 4,572,983 | A | 2/1986 | Ragland, Jr. |
| 5,382,871 | A | 1/1995 | Funashi et al. |
| 5,914,557 | A | 6/1999 | Tai et al. |

FOREIGN PATENT DOCUMENTS

| | | |
|---|---|---|
| EP | 1 001 446 A1 | 5/2000 |
| JP | 10-125247 | 5/1998 |

*Primary Examiner*—Vip Patel
(74) *Attorney, Agent, or Firm*—Birch, Stewart, Kolasch & Birch, LLP

(57) ABSTRACT

Disclosed is a color cathode ray tube that can optimize the distance between a spring hole of a spring and a welded junction point and the distance between the junction points with respect to the weight of a mask-frame assembly. The color cathode ray tube includes the mask-frame assembly and a panel that are assembled together by fastening a fixing pin formed on an inner surface of the panel into the spring hole formed on one end portion of the spring of which the other end portion is fixed to the mask-frame assembly directly or through two or more junction points of a spring holder. The cathode ray tube satisfies the condition of $5.0<(A/B)\times W\leqq 8.0$, where A(cm) is a distance between a center of the spring hole and a center of the junction point most adjacent to the spring hole (i.e., the shortest junction point), B(cm) is a distance between the center of the shortest junction point and the center of the junction point apart farthest from the spring hole (i.e., the farthest junction point), and W(kg) is a shared weight of the mask-frame assembly exerting on each spring for supporting the mask-frame assembly.

3 Claims, 5 Drawing Sheets

COLOR CATHODE RAY TUBE

This nonprovisional application claims priority under 35 U.S.C. §119(a) on patent application Ser. No. 2002-286 filed in Korea on Jan. 3, 2002, which is herein incorporated by reference.

BACKGROUND OF THE INVENTION

1. Field of the Invention

The present invention relates to a color cathode ray tube, and more particularly, to a tension mask frame assembly structure for a color cathode ray tube.

2. Discussion of the Related Art

FIG. 1 is a schematic sectional view of a general color cathode ray tube, and FIG. 2 is a sectional view of a panel of the color cathode ray tube of FIG. 1.

Referring to FIG. 1, the general color cathode ray tube is provided with a panel 1 that is a front glass, a funnel 2 that is a rear glass fastened to the panel 1, a fluorescent screen 4 formed on an inner surface of the panel 1, an electron gun that is the source of electron beams 6 irradiated onto the fluorescent screen 4, a mask 3 for guiding the electron beams to the fluorescent screen 4 corresponding to selected colors, and a main frame 7 for supporting the mask 3.

The color cathode ray tube is also provided with a spring 9 for fastening the mask-frame assembly to the panel, and an inner shield 11, fixed to the frame, for serving as a shield so that the cathode ray tube is little affected by an external earth magnetism during its operation. The color cathode ray tube is sealed in a high vacuum state.

The operation of the color cathode ray tube as constructed above will be explained.

The electron beams 6 radiated from an electron gun 13 mounted in a neck of the funnel 2 strike the fluorescent screen 4 formed on the inner surface of the panel according to an anode voltage applied to the cathode ray tube. At this time, the electron beams 5 are deflected in upward, downward, left, and right directions by a deflection yoke 5 before they reach the fluorescent screen to form a picture.

A two/four/six-electrode magnet 12 corrects the moving trace of the electron beams 6 so that the electron beams 6 accurately strike the predetermined fluorescent material, and thus the color purity is prevented from being inferior.

The cathode ray tube is in the high vacuum state, and thus may be easily cracked under an external impact. To prevent this, the panel 1 is designed to have a structural strength that can endure the atmospheric pressure. Also, by mounting a reinforcement band 14 on a skirt of the panel 1, the stress acting on the cathode ray tube of the high vacuum state is dispersed to secure its impact-resistant performance.

Conventionally, a spring holder 10 (See FIG. 4) is welded on the frame 7 of the mask assembly. One end portion of a spring 9 for enabling the spring holder 10 to fasten to the panel 1 is fixed to the spring holder 10 by welding, and the other end portion of the spring 9 forms a free end having a spring hole 9*a* formed thereon. The spring 9 has a bent portion to be properly spaced apart from the frame. Meanwhile, a fixing pin 15 is formed on the inner surface of the panel, and the mask-frame assembly is fixed to the panel by fastening the fixing pin 15 of the panel into the spring hole 9*a*.

As described above, the mask-frame assembly is detachably fixed to the panel 1, and thus fluorescent stripes and black matrices can be formed on the inner surface of the panel by repeating the process of coating a photoresist material including a photosensitive material or fluorescent material slurry on the inner surface of the panel in a state that the mask-frame assembly is separated from the panel, and then exposing them to light in a state that the mask-frame assembly is fasten to the panel.

However, since the mask-frame assembly is assembled to the panel 1 by welding and using the spring pressure of the spring 9, the electron beam is not just landing on a specified position without any positional deviation, it deviates from its original position due to an impact by dropping and so on as shown in FIG. 3. That is, the position on which the electron beam strikes the fluorescent material deviates from its center, and this causes a color mismatch that is called a mislanding to occur, thereby deteriorating the picture quality. Conventionally, in order to minimize the color mismatch due to the impact, there have been measures for preventing the positional deviation of the mask-frame assembly such as shape improvement of the spring, reinforcement of the spring pressure, etc.

As the cathode ray tube is becoming large-sized, the weight of the mask-frame assembly is being increased, and thus it becomes necessary to reduce the weight of the panel and to place the mask-frame assembly closest to the inner surface of the panel. However, the shape improvement or the material for the spring is limited with the increase of the spatial limitation and manufacturing cost.

Meanwhile, Japanese Patent Unexamined Publication No. 10-125247 discloses a cathode ray tube in that a mask-frame assembly is assembled with a panel by fastening a fixing pin formed on an inner surface of the panel to a spring hole formed on one end portion of a spring of which the other end portion is fixed to the mask-frame assembly directly or through two or more junction points of a spring holder. In this cathode ray tube structure, it is prescribed that $(A/B)\times W \leqq 5.0$, where A(cm) is a distance between the center of the spring hole and the center of the junction point most adjacent to the spring hole (i.e., the shortest junction point), B(cm) is a distance between the center of the shortest junction point and the center of the junction point farthest apart from the spring hole (i.e., the farthest junction point), and W(kg) is a shared weight of the mask-frame assembly exerted on each spring for supporting the mask-frame assembly.

However, according to this cathode ray tube structure, the color mismatch due to the positional deviation still frequently occurs during the process of repeating insertion/separation of the spring onto/from the fixing pin of the panel, and the manufacturing cost is increased due to waste of unnecessary materials for the spring holder to secure the welded junction points. Also, the spring holder interferes with a damper wire installed on a sub frame of the mask-frame assembly for damping the vibration of the assembly.

SUMMARY OF THE INVENTION

Accordingly, the present invention is directed to a color cathode ray tube that substantially obviates one or more problems due to limitations and disadvantages of the related art.

An object of the present invention is to provide a color cathode ray tube that can optimize a distance between a spring hole of a spring and a welded junction point and a distance between the junction points with respect to the weight of a mask-frame assembly.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a color cathode ray tube includes a mask-frame assembly and a panel that are assembled together by fastening a fixing pin formed on an inner surface of the panel into a spring hole formed on one end portion of a spring of which the other end portion is fixed to the mask-frame assembly directly or through two or more junction points of a spring holder, wherein the cathode ray tube satisfies the condition of $5.0<(A/B)\times W\leqq 8.0$, where A(cm) is a distance between a center of the spring hole and a center of the junction point most adjacent to the spring hole (i.e., the shortest junction point), B(cm) is a distance between the center of the shortest junction point and the center of the junction point apart farthest from the spring hole (i.e., the farthest junction point), and W(kg) is a shared weight of the mask-frame assembly exerting on each spring for supporting the mask-frame assembly.

Here, it is preferable that an elastic modulus of the spring is in the range of 18000~24000 kgf/mm$^2$.

Also, it is preferable that a thickness of the spring is in the range of 1.0~1.5 mm.

According to the present invention as constructed above, the relative positional deviation between the mask-frame assembly and the panel is minimized, and thus the color mismatch (i.e., mislanding) is reduced during the operation of the cathode ray tube.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 4:
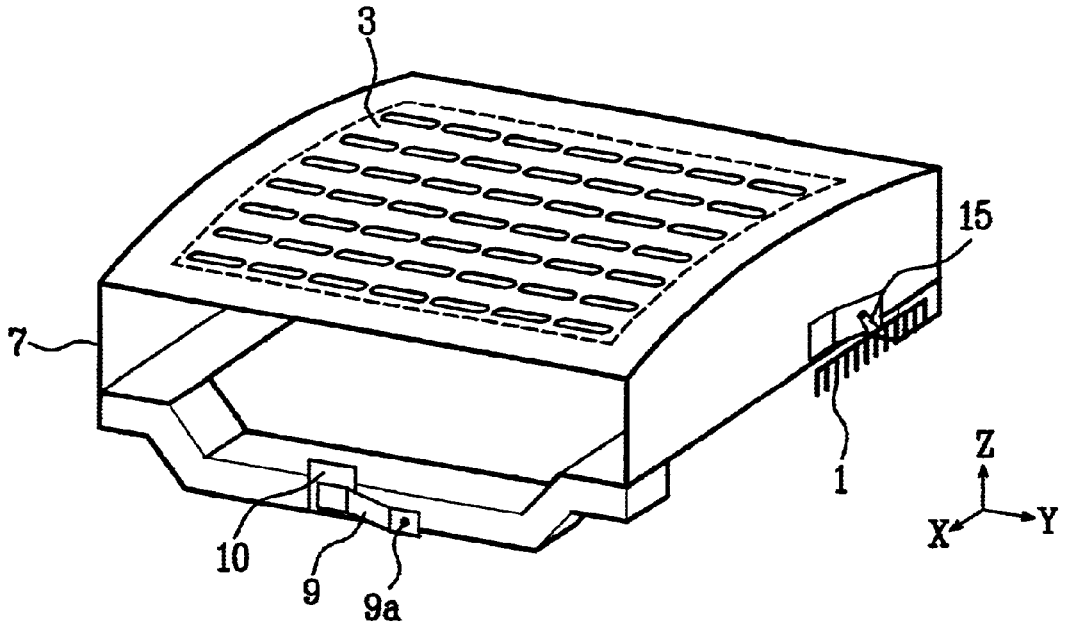
FIG. 4 is a perspective view of a mask-frame assembly in a general shape according to the present invention.

FIG. 4 is a perspective view of a mask-frame assembly in a general shape according to the present invention.

The mask-frame assembly includes a main frame 7 and a sub frame 8 connected to the main frame 7. A mask 3 is mounted on the frame, and a spring holder 10 is welded on the frame. On this spring holder 10 is mounted a spring 9 through two or more welded junction points 16*a* and 16*b*. The spring 9 has one free end portion having a spring hole 9*a* into which a fixing pin 15 of a panel 1 is inserted.

Figure 1:
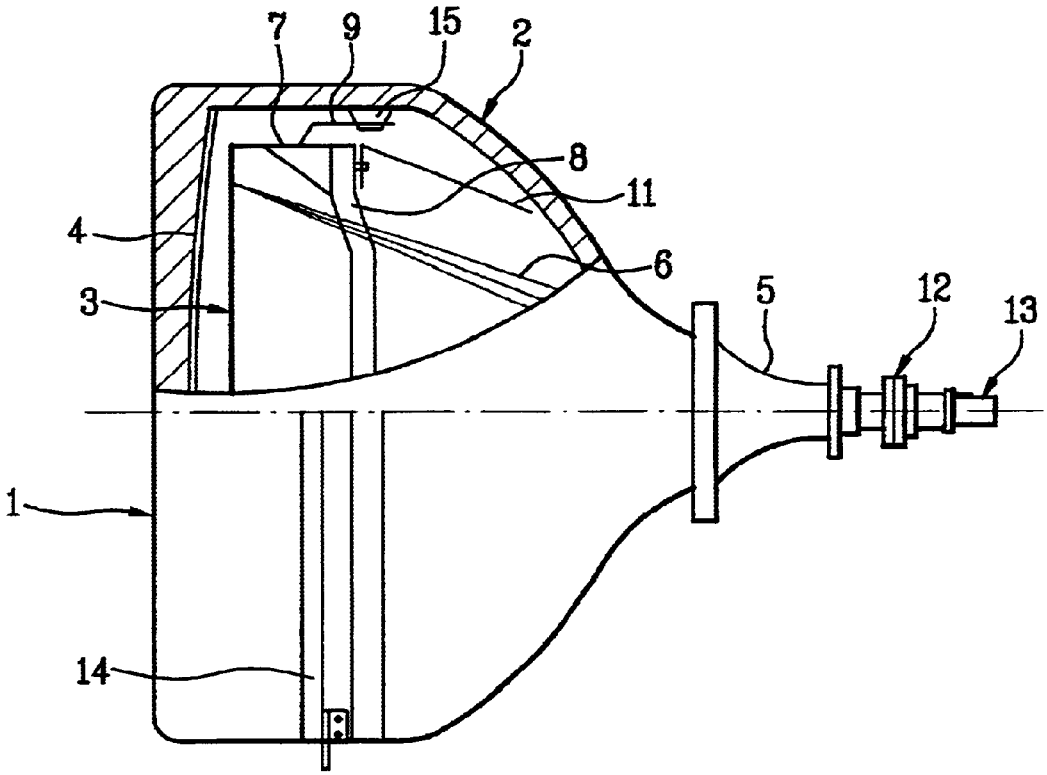
FIG.1 Related Art
FIG. 1 is a schematic sectional view of a general color cathode ray tube.
Figure 2:
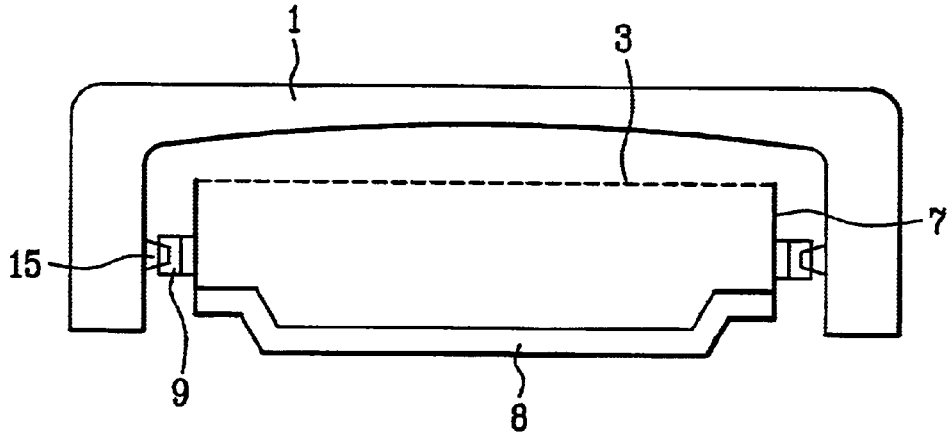
FIG.2 Related Art
FIG. 2 is a sectional view of a panel of the color cathode ray tube of FIG. 1.
Figure 3:
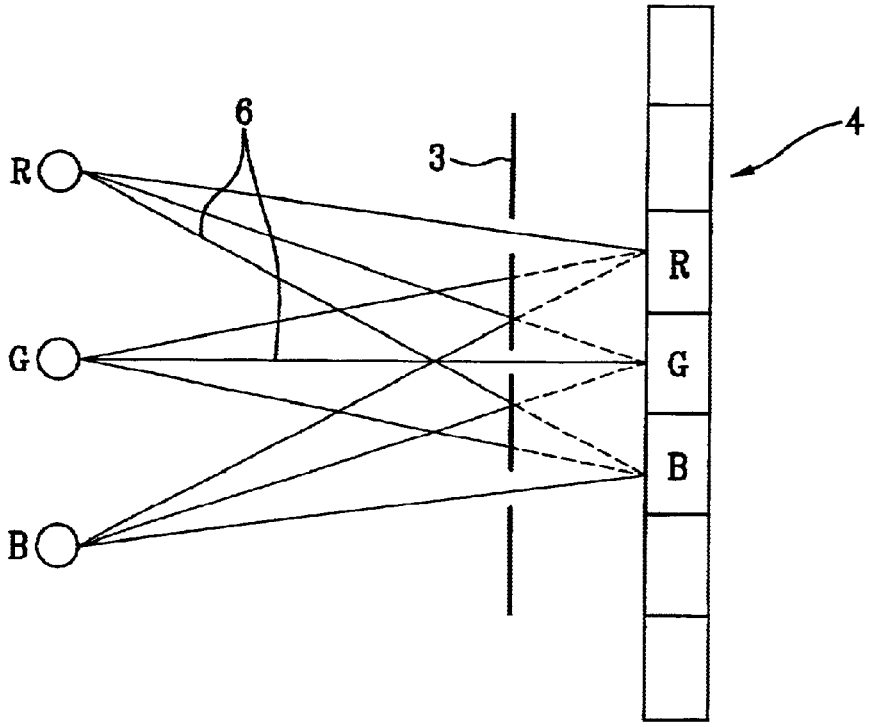
FIG.3 Related Art
FIG. 3 is a view schematically illustrating electron beams in a just landing state.

Electron beams 6 emitted from an electron gun 13 are deflected to specified directions by a deflection yoke 5 as shown in FIG. 1, and then reach a fluorescent screen 4 after passing through the mask to strike the fluorescent material.

Figure 5:
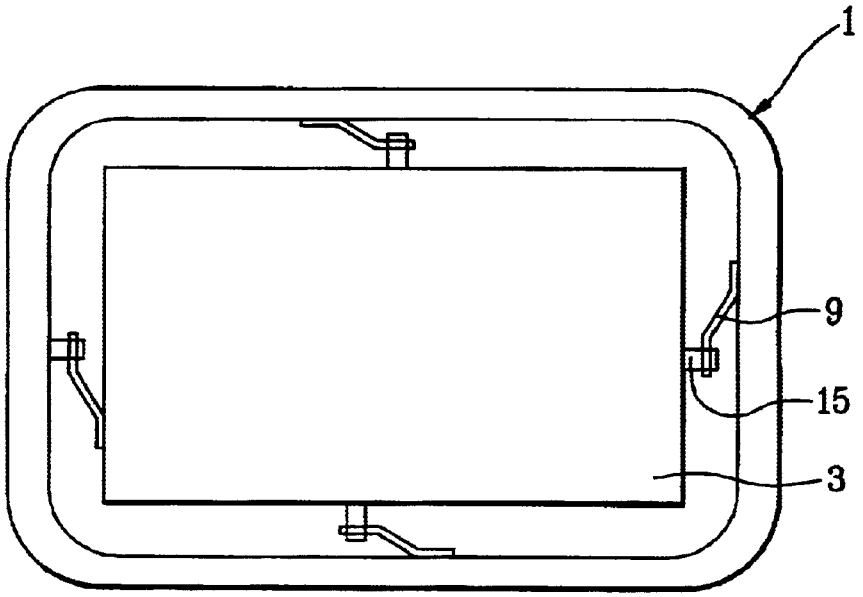
FIG. 5 is a view illustrating a mask-frame assembly and a panel in an assembled state using a spring according to the present invention.

In addition to a method of fixing a mask-frame assembly to a panel as shown in FIG. 5, the present invention can adopt any other fixing method such as a 3-pin type fixing method, a 4-pin type fixing method with 4 pins positioned on corner parts of the panel, etc. Also, the spring 9 may be directly welded on the frame 8 without using the spring holder 10 illustrated in FIG. 4.

Figure 6:
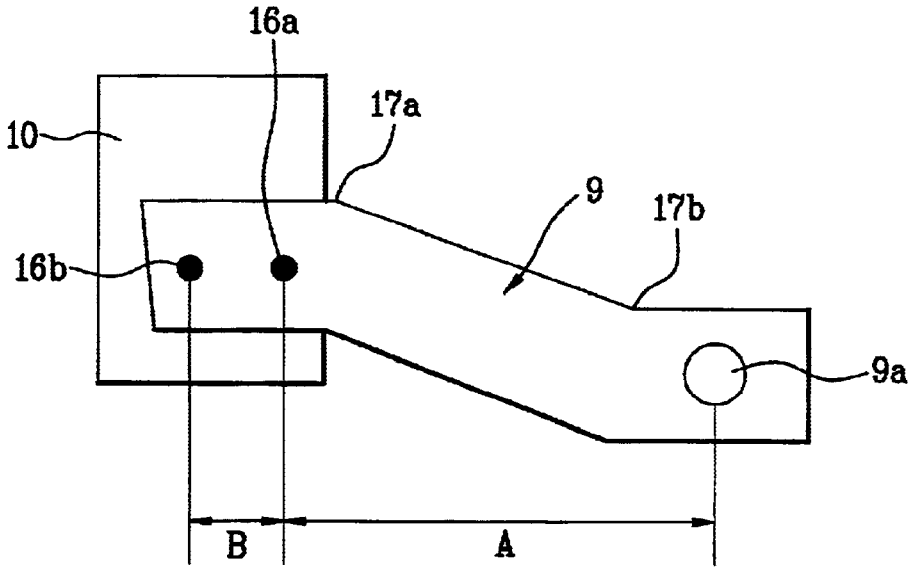
FIG. 6 is an enlarged view of a spring holder and a spring according to the present invention.

FIG. 6 is an enlarged view of the spring holder 10 and the spring 9 according to the present invention.

One end portion of the spring 9 is welded on the spring holder 10 through two or more welded junction points, and the other end portion of the spring forms a free end having a spring hole 9*a* into which a fixing pin 15 of the panel is inserted. Also, the spring has a bent portion, formed near the spring holder 10, for providing elasticity, and thus when the fixing pin 15 of the panel 1 is inserted into the spring hole 9*a*, the mask-frame assembly is fixed to the panel using the spring pressure of the spring.

The present invention optimizes the distance between the spring hole 9*a* of the spring 9 and the shortest welded junction point 16*a* and the distance between the shortest welded junction point 16*a* and the farthest welded junction point 16*b* with respect to the weight of the mask-frame assembly.

As shown in FIG. 6, the present invention adopts two or three welded junction points for the spring. Also, in order to improve the fastening degree, the present invention may adopt a first bent portion 17*a* that is near to the spring holder 10 and a second bent portion 17*b* that is near to the spring hole 9*a*.

The present invention provides a color cathode ray tube including a mask-frame assembly and a panel that are assembled together by fastening the fixing pin 15 formed on an inner surface of the panel into the spring hole 9*a* formed on one end portion of the spring 9 of which the other end portion is fixed to the mask-frame assembly directly or through two or more junction points of the spring holder 10. This cathode ray tube satisfies the condition of $$5.0<(A/B)\times W\leqq 8.0 \quad \text{(Eq. 1)}$$

where A(cm) is a distance between the center of the spring hole 9*a* and the center of the junction point most adjacent to the spring hole 9*a* (i.e., the shortest junction point 16*a*), B(cm) is a distance between the center of the shortest junction point and the center of the junction point apart farthest from the spring hole 9*a* (i.e., the farthest junction point 16*b*), and W(kg) is a shared weight of the mask-frame assembly exerting on each spring 9 for supporting the mask-frame assembly.

Figure 7:
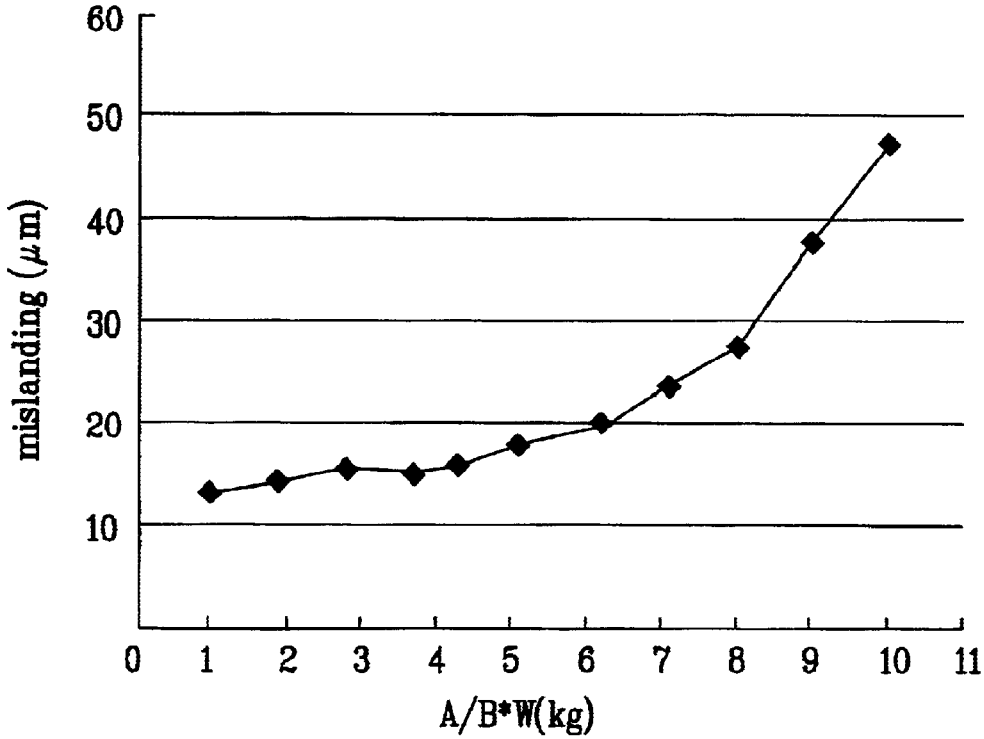
FIG. 7 is a graph illustrating the amount of mislanding due to a dropping impact on a panel.

This is based on the fact resulted from a research for the relationship between the distance between the spring hole and the junction point and the weight of the mask-frame assembly exerted on the spring in the spring 9 of which one end portion is fixed to the mask-frame assembly through two or more junction points and of which the other end portion has the spring hole 9*a*, that is, if the condition of the equation 1 is satisfied, the positional deviation of the mask-frame assembly against the panel due to the dropping impact comes in an allowable range where the correction of the positional deviation is possible. Specifically, FIG. 7 is a graph illustrating the result of measuring the amount ($\mu$m) of mislanding of the electron beam when a constant dropping impact (20G) is given with values of A, B, and W being changed. As shown in FIG. 7, the amount of mislanding of the electron beam abruptly increases if the value of (A/B)×W exceeds 8, and the mislanding value is below 30 $\mu$m if the value of (A/B)×W is less than 8. It is typically known that the amount of mislanding that can be compensated for is below 30 $\mu$m.

However, since the spring 9 has the bent portion that is formed near the spring holder 10 for easy attachment/detachment of the mask-frame assembly to/from the panel, it is impossible to bring the position of the welded point that is near the spring hole 9*a*, i.e., the shortest welded point 16*a*, infinitely in the direction of the spring hole 9*a* during the welding operation of the spring on the mask-frame assembly. That is, it meets a problem in manufacture to take the B value larger (i.e., in a direction that the value of (A/B)×W approaches 0) as taking the A value smaller. Also, the increase of the B value means that the distance between two welded junction points becomes greater, and in this case, the size of the spring holder that enable the weld of the spring on the frame increases unnecessarily, so that the spring holder causes interference with a damper wire (not illustrated) installed on the mask-frame assembly for the purpose of damping the vibration of the assembly. Especially, in case that the spring has two bent portions for improving the fastening force of the spring with the panel, it is preferable to take the value of (A/B)×W more than 5 to secure the full manufacturing tolerance.

Figure 8:
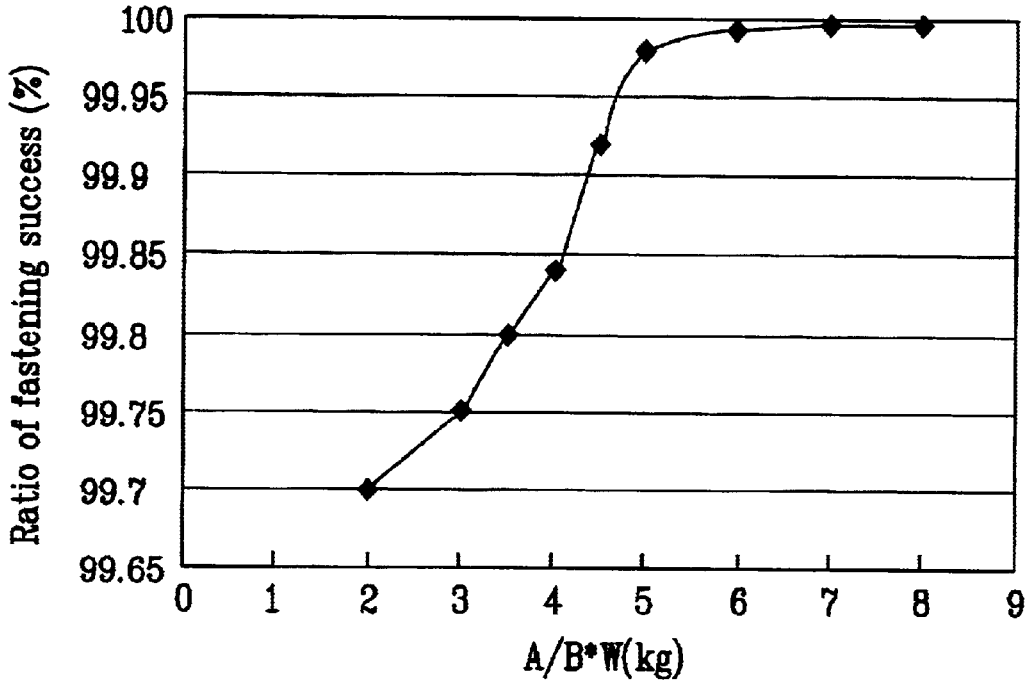
FIG. 8 is a graph illustrating the ratio of success in fastening a panel fixing pin and a spring during a process of attaching/detaching a spring to/from the panel fixing pin.

FIG. 8 illustrates a result of testing the ratio of success as changing the value of (A/B)×W during the process of repeating attachment/detachment of the spring to/from the panel fixing pin in manufacturing the cathode ray tube. As shown in FIG. 8, the ratio of success is satisfactory when the value is more than 5. Accordingly, the equation 1 presents the range that can accord the purpose of the present invention and solve the above-described problems.

The material of the spring is not specially limited, but it is preferable that its elastic modulus is in the range of 18000~24000 kgf/mm$^2$. Also, it is preferable that the thickness of the spring is in the range of 1.0~1.5 mm.

According to the color cathode ray tube of the present invention as described above, the relative positional deviation between the mask-frame assembly and the panel due to the dropping impact and so on is minimized with the manufacturing cost and the productivity improved, and the color mismatch (i.e., mislanding) due to the positional deviation is reduced, thereby enabling the manufacture of a high-quality large-sized cathode ray tube.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A color cathode ray tube comprising a mask-frame assembly and a panel that are assembled together by fastening a fixing pin formed on an inner surface of the panel into a spring hole formed on one end portion of a spring of which the other end portion is fixed to the mask-frame assembly directly or through two or more junction points of a spring holder, wherein the color cathode ray tube satisfies the condition of $5.0<(A/B)\times W\leqq 8.0$, where A(cm) is a distance between a center of the spring hole and a center of the junction point most adjacent to the spring hole (i.e., the shortest junction point), B(cm) is a distance between the center of the shortest junction point and the center of the junction point apart farthest from the spring hole (i.e., the farthest junction point), and W(kg) is a shared weight of the mask-frame assembly exerting on each spring for supporting the mask-frame assembly.

2. The color cathode ray tube of claim 1, wherein an elastic modulus of the spring is in the range of 18000~24000 kgf/mm$^2$.

3. The color cathode ray tube of claim 1, wherein a thickness of the spring is in the range of 1.0~1.5 mm.

* * * * *